US007780242B2

(12) United States Patent
Sollami

(10) Patent No.: US 7,780,242 B2
(45) **Date of Patent: *Aug. 24, 2010**

(54) RETAINER SLEEVE AND WEAR RING FOR A ROTATABLE TOOL

(75) Inventor: Phillip A. Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 261 days.

This patent is subject to a terminal disclaimer.

(21) Appl. No.: 11/716,827

(22) Filed: Mar. 12, 2007

(65) Prior Publication Data

US 2007/0152495 A1 Jul. 5, 2007

Related U.S. Application Data

(63) Continuation-in-part of application No. 10/952,158, filed on Sep. 28, 2004, now Pat. No. 7,229,136.

(51) Int. Cl.
*E21C 35/197* (2006.01)

(52) U.S. Cl. ..... 299/104; 299/107

(58) Field of Classification Search ..... 299/102–107, 299/110–111

See application file for complete search history.

(56) References Cited

U.S. PATENT DOCUMENTS 4,844,550 A * 7/1989 Beebe ..... 299/107
5,931,542 A * 8/1999 Britzke et al. ..... 299/104
6,824,225 B2 * 11/2004 Stiffler ..... 299/104
7,118,181 B2 * 10/2006 Frear ..... 299/104
7,229,126 B2 * 6/2007 Seifert ..... 296/220.01
2006/0071538 A1 * 4/2006 Sollami ..... 299/104

FOREIGN PATENT DOCUMENTS

DE 10040562 A1 * 3/2002
WO WO 03042500 A1 * 5/2003

* cited by examiner

*Primary Examiner*—Sunil Singh
(74) *Attorney, Agent, or Firm*—Robert L. Marsh

(57) ABSTRACT

A compressible sleeve for fitting around the shank of a rotatable tool has a cut out portion at the forward end thereof. The sleeve is compressed to a diameter less than the inner diameter of the bore of a tool holder by an annular wear ring having an inwardly directed projection that retains the cylindrical sleeve to a diameter that is less than the diameter of the bore of the tool holder. When the shank of the tool is driven into the bore of the tool holder, the wear ring is forced forwardly along the sleeve until the projection falls in the cut out portion of the sleeve allowing the sleeve to expand to the diameter of the bore of the tool holder and locking the wear ring from rotating with the tool.

18 Claims, 7 Drawing Sheets

RETAINER SLEEVE AND WEAR RING FOR A ROTATABLE TOOL

The present application is a Continuation-in-Part of my application filed Sep. 28, 2004 and assigned Ser. No. 10/952,158 now U.S. Pat. No. 7,229,136. The present application relates to rotatable tools mounted in non-rotatable retainers in machines used to cut hard surfaces, and in particular to an improved retainer sleeve for retaining the shank of the tool in the tool holder, and to an improved wear ring positioned between the tool and the tool holder.

BACKGROUND OF THE INVENTION

Machines for cutting hard surfaces, such as used in the trenching and mining industries and for removing the upper surfaces of concrete and asphalt pavement, employ tools fitted into tool holders on a rotatable wheel or drum. The tools have a tapered forward cutting end and axially located behind the forward cutting end is a cylindrical shank that rotatably fits within a complementarily shaped bore in the tool holder. Between the forward cutting end and the shank, the tools have a rearwardly directed annular surface or flange that contacts the forward surface of the tool holder. Force is applied through the rotating drum or wheel to the tool holder and through the radial flange to the tool to thereby force the tool into the hard surface to be cut.

The shank of the tool is retained in the bore of the tool holder by a sleeve made of a spring steel that fits around the shank of the tool and engages a shoulder on the shank to prevent the shank from being removed from the sleeve. The sleeve is compressed during the insertion of the shank and sleeve into the bore of the tool holder after which the radially outward force applied by the sleeve against the inner wall of the bore retains the shank of the tool within the bore. The radially outwardly directed force applied by the sleeve as it is compressed prior to insertion into the bore of the tool holder also complicates the insertion process.

To receive the tool and compressed sleeve, the bore of the tool holder has a frustoconical countersink, with the outermost diameter of the countersink being larger than the outermost diameter of the unstressed sleeve. To insert the tool into the tool holder, the distal end of the shank is fitted into the bore with the rearward edge of the sleeve abutting the frustoconical surface of the countersink surrounding the bore. Thereafter, the nose of the tool is struck with a hammer or the like, forcing the shank of the tool and the sleeve rearwardly. As the sleeve moves axially into the bore, it is compressed by the frustoconical countersink and the bore of the holder.

The insertion of the tool into a tool holder requires a machine operator to use both hands. In many cases, however, the drum or wheel of the machine is in such an orientation that the tool holder is inaccessible to both hands of the technician without a time consuming repositioning of the drum or the technician's body. It would greatly simplify the insertion of replacement tools in the tool holders of a machine if a technician could position and insert the tool into a tool holder using only one hand.

During the operation of such machines, the useful life of the tools is enhanced by the rotation of the tool, causing it to wear evenly around its circumference. The tools are mounted at an angle of about seven degrees axially on the drum or wheel and the contact of the tool body with the surface to be cut applies a component of force to the side of the tool that is axial and perpendicular to the axis of rotation. The rotation of the flange of the tool against the forward surface of the tool holder causes wear to the forward surface of the tool holder.

To prevent such wear, it has become common to provide an annular wear ring around the shank of the tool between the forward surface of the tool holder and the rearwardly directed flange of the tool.

When the wear ring operates properly, the wear ring remains stationary against the forward surface of the tool holder while the tool rotates against the forward surface of the wear ring such that only the forward surface becomes worn away. Currently existing wear rings are retained in the stationary position by the resistance caused between the forward end of the tool holder and the rearward surface of the wear ring, which is generally greater than the resistance between the forward surface of the wear ring and the rearwardly directed radial flange of the tool. Although this is so, there is a tendency for the wear ring to rotate with respect to the forward end of the tool holder. The same forces that cause the tool body to rotate also cause the wear ring to rotate. Considering that a tool may undergo as many fifty thousand rotations within a single day, the forward end of the tool holder will undergo a significant wear caused by the rotation of the wear ring. It would be desirable, therefore, to provide a wear ring that is retained against rotation with respect to the tool holder.

Several problems are also encountered in removing the tool from a tool holder. Presently, it is the practice to provide an annular groove around the tapered forward cutting end of the tool that can be grasped by the prongs of an extraction tool. Where a wear ring is fitted around the shank of the tool, the use of existing extraction tools may result in the wear ring falling off the end of the shank of the tool onto the work surface below the machine. As a result, the machine operator may be required to collect the dropped wear rings after the defective tools of the machine have been replaced.

Several efforts have been made to overcome the foregoing problems, and one of the most notable is disclosed by Simon, U.S. Pat. No. 4,818,027. Simon discloses a rotatable tool having an axial shank, a compressible sleeve fitted around the shank, and a wear ring fitted around the compressible sleeve with the inner diameter of the wear ring equal to or less than the diameter of the bore of the tool holder. The shank has a shoulder at the forward end thereof that is spaced from the radial flange, and the forward end of the sleeve abuts against the shoulder. With the sleeve compressed by the wear ring, the distal end of the shank can be more easily fitted into the bore of the tool holder to thereby facilitate the insertion of the shank into the tool holder. As the shank of the tool is driven deeper and deeper into the bore, the wear ring is forced forwardly off of the forward end of the sleeve after which all the radially outwardly directed forces of the compressed sleeve are applied to the inner surface of the bore to retain the tool in the bore.

Although the device of Simon does assist in the insertion of the shank of the tool into a tool holder, and provides for a wear ring between the forward surface of the tool holder and the rearwardly directed annular surface of the flange, the wear ring is retained against rotation with the tool only by the friction between the forward surface of the tool holder and the rearward surface of the wear ring and therefore tends to rotate with the tool.

There are certain problems that have been found with the structure of the sleeve and wear ring of Simon. The rotation of the shank within the sleeve of Simon requires that the forward edge of the sleeve abut against an annular shoulder that is spaced from the surface of the radial flange. However, it has been found that during the use of the tool the sleeve of Simon becomes somewhat extruded, causing it to lengthen, and as the sleeve lengthens the forward end thereof is forced over the annular shoulder. The sleeve then becomes pinched between the enlarged diameter portion of the shank adjacent the radial flange and the bore of the tool holder, thereby preventing or inhibiting the rotation of the tool. Where the tool fails to rotate properly, it will become prematurely worn and reduce the efficiency of the machine or require frequent service.

Products currently made in accordance with Simon include a wear ring with an inner diameter equal to the diameter of the bore, and as a result, the distal end of the shank cannot be manually inserted into the bore of a tool holder using one hand. Efforts to provide a wear ring having a central opening that is less than the diameter of the bore to thereby further compress the sleeve until the distal end of the shank and sleeve may be manually fitted within the bore have resulted in an increase in the incidence of wedging between the shank and the bore. This is because the bore of the wear ring must be made smaller than the diameter of the bore of the holder, and since the enlarged portion of the shank must rotate within the bore of the wear ring, the shoulder at the forward end of the shank must be correspondingly reduced.

SUMMARY OF THE INVENTION

Briefly, the present invention is embodied in a compressible sleeve and an associated wear ring, which overcome or greatly reduce the forgoing problems. The tool for which the sleeve and wear ring of the present invention are used includes a tapered forward cutting end, an axial shaft extending rearwardly of the forward cutting end, and a rearwardly facing annular surface joining the rearward end of the forward cutting end and the forward end of the shank. Fitted around the shank is a compressible sleeve having an axis and a longitudinal slot therein forming parallel spaced apart slot edges. The compressible sleeve also has a forward end that abuts against the rearwardly facing annular surface of the forward cutting end of the tool.

In accordance with the invention, the compressible sleeve has a cut out portion having a determined arcuate width at the forward end thereof. In my co-pending application Ser. No. 10/952,158, I disclosed that the cut out portion may be at the forward ends of one or both of the slot edges. I have found that inventions perform equally well when the cut out portion is angularly or circumferentially spaced from the slot edges and, preferably, the cut out portion is positioned about one hundred eighty degrees from the parallel slot edges. Fitted around the circumference of the sleeve is an annular wear ring having a generally circular central opening, the inner diameter of which is greater than the diameter of the bore of the tool holder in which the shank is to be fitted. The central opening of the wear ring also has a radially inwardly extending projection having an outer end. The distance between the outer end of the inwardly extending projection and the portion of the wall defining the central opening that is diametrically opposite the projection is less than the inner diameter of the bore of the tool holder. The wear ring is positioned around the compressible sleeve with the protrusion aligned axially behind the cut out portion at the forward end of the sleeve.

With the parts assembled as described above, the sleeve will be compressed between the end of the projection and the portion of the wall of the central opening diametrically opposite the projection to a diameter that is less than the diameter of the bore of the tool holder such that a machine operator can, with one hand, insert the distal end of the shank and compressed sleeve into the bore of a tool holder until the rearward surface of the wear ring abuts the forward surface of the tool holder. With the tool partially inserted into the tool holder, the technician can release his grip on the tool, grasp a hammer, and pound the nose of the tool until the balance of the shank is driven into the bore. A technician can therefore insert the tool into the machine using only one hand.

The radially inwardly projecting protrusion of the wear ring has an angular width that is less than the arcuate width of the cut out portion. As the machine operator pounds the nose of the tool and the shank is driven into the bore, the wear ring is moved forwardly and axially along the length of the sleeve until the protrusion drops into the cut out portion of the sleeve, thereby allowing the sleeve to expand until its outer surface abuts the inner surface of the bore, thereby retaining the tool in the tool holder.

When the machine is subsequently put into use, the tool will rotate within the sleeve, but the wear ring will be retained against rotation by the ends of the cut out portion of the sleeve that engage the sides of the protrusion of the wear ring. The wear ring is therefore locked with the sleeve and cannot rotate without causing rotation of the sleeve.

In the preferred embodiment, the shank of the tool has an annular groove near the distal end thereof and the compressible sleeve extends around nearly the entire length of the shank with the distal end of the sleeve being adjacent the distal end of the shank. One or more rearwardly directed tabs are cut out from the wall of the sleeve with the free end of the tabs extending rearwardly and radially inwardly into the annular groove in the shank to prevent the shank form being withdrawn from the compressible sleeve.

BRIEF DESCRIPTION OF THE DRAWINGS

A better understanding of the present invention will be had after a reading of the following detailed description taken in conjunction with the drawings wherein.

DETAILED DESCRIPTION OF PREFERRED EMBODIMENTS

Figure 1:
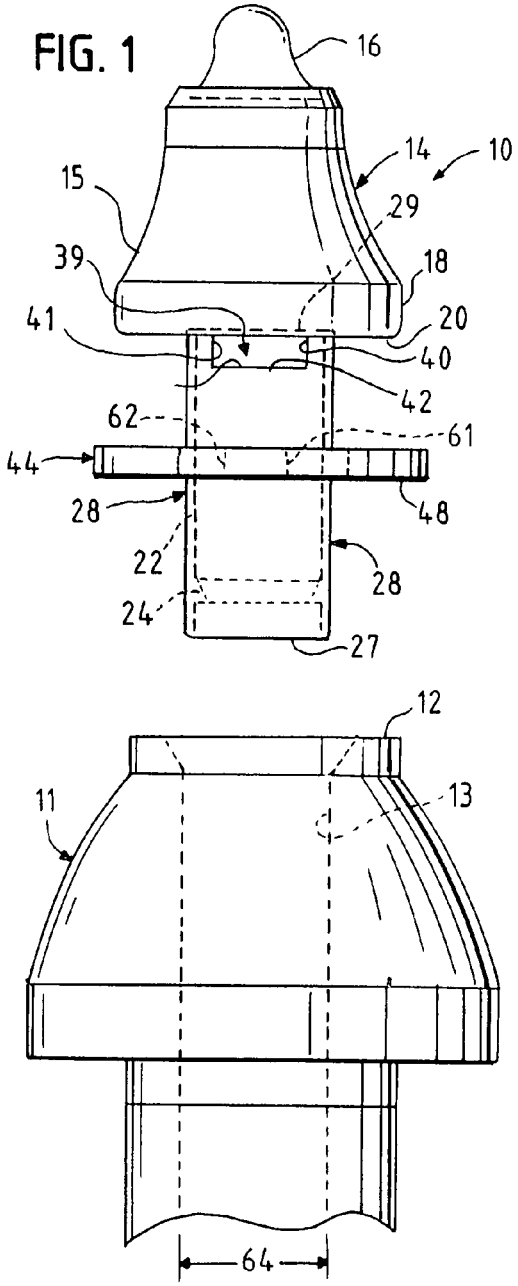
FIG. 1 is a side elevational view of a tool fitted with a sleeve and a wear ring in accordance with the present invention positioned for insertion into a tool holder, with the inner parts thereof shown in broken lines.
Figure 2:
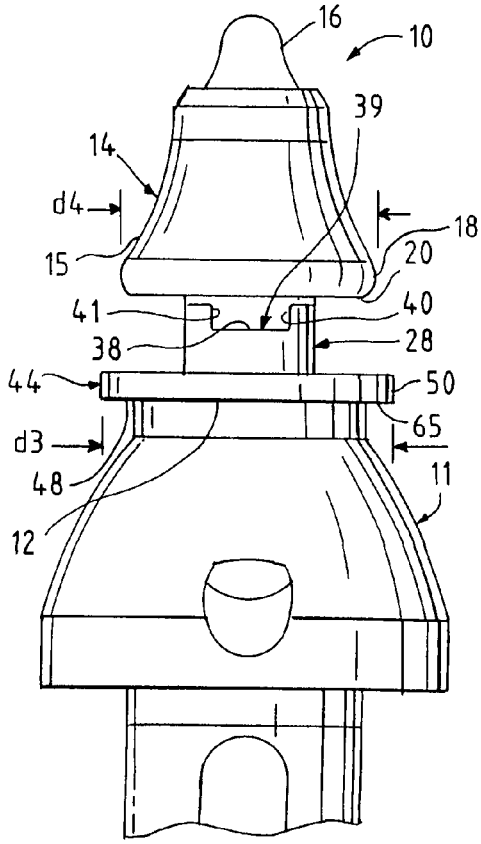
FIG. 2 is a second side-elevational view of the tool and tool holder shown in FIG. 1 with the shank of the tool partially inserted into the bore of the tool holder.
Figure 3:
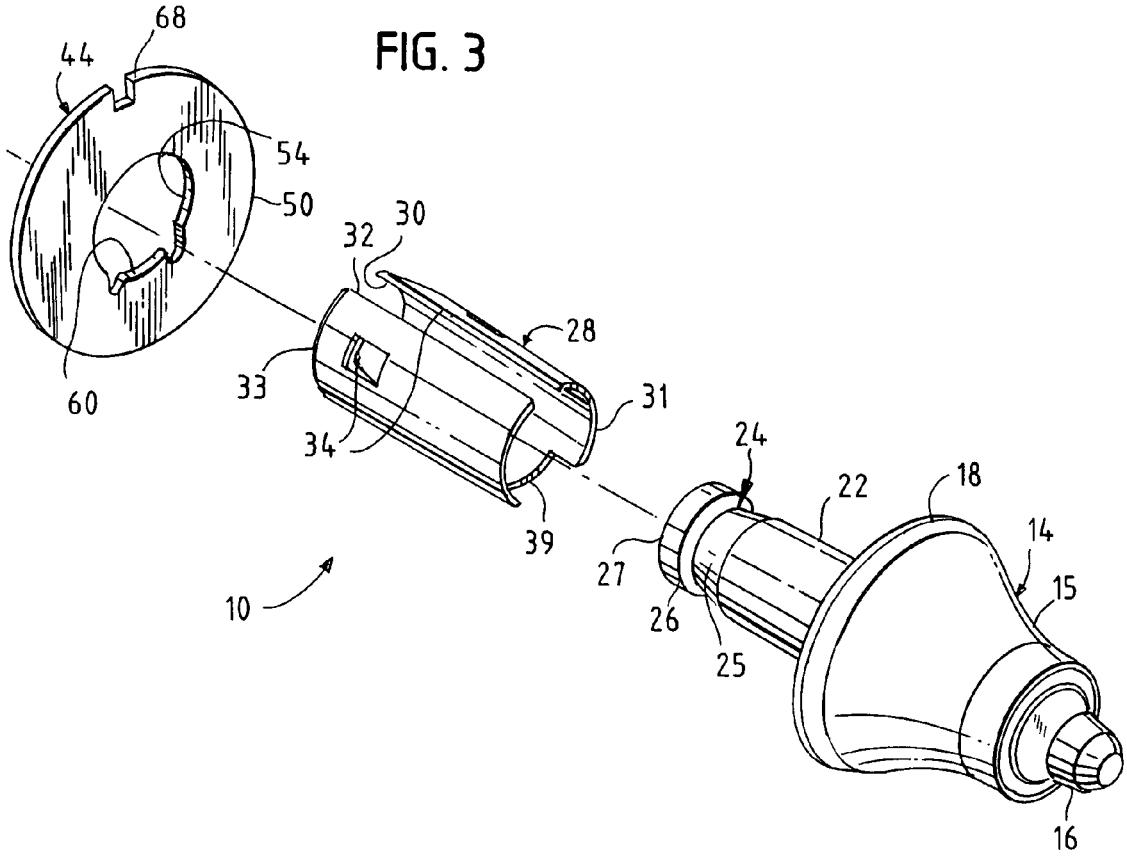
FIG. 3 is an exploded view of a tool having a compressible sleeve and a wear washer in accordance with the present invention.

Referring to FIGS. 1, 2, and 3, a tool 10 is suitable for being rotatably mounted in a tool holder 11 having a planar forward surface 12 and a bore 13, the axis of which is perpendicular to the forward surface 12. The tool holder 11 may be mounted directly to the drum or wheel of the machine or may be mounted to a base block which accepts a quick change holder as depicted. The tool 10 includes a tool body 14 having a tapered forward cutting portion 15 at the forward end of which is a seat into which is brazed a hardened cutting tip 16. The cutting portion 15 flares outwardly near its rearward end to a flange 18 having a generally planar annular rearward surface 20. Extending axially rearwardly from the center of the annular rearward surface 20 is a cylindrical shank 22 having an annular groove 24 near the distal end thereof. The groove 24 includes a frustoconical forward surface 25 and rearwardly of the frustoconical surface 25 a generally planar annular shoulder 26.

As shown in FIG. 3, the cylindrical body of the shank 22 extends without interruption, except from the groove 24, from the rearward surface 20 to the distal end 27.

Fitted around the shank 22 and extending for most of the length thereof is a compressible sleeve 28 having an arcuate forward surface 31 that abuts against the rearward surface 20 of the tool body 14 and a rearward end 33 adjacent the distal end 27 of the shank 22. As shown in FIG. 1, to ensure that the forward surface 31 of the sleeve 28 can be positioned co-planar with the plane of the rearward annular surface 20 of the flange 18, an undercut 29 may be provided at the junction of the shank 22 with the rearward surface 20 to remove any filet that may otherwise be formed between these two surfaces. The outer surface of the sleeve 28 defines a cylinder and, behind the forward end 31 no portion of the sleeve 28 extends radially outward of the cylinder.

Since the sleeve 28 extends to the rearward surface 20 of the flange 18 it will never become pinched between a shoulder near the flange and the tool holder 11 as was the case with Simon. The sleeve 28 can therefor be made to fit to closer longitudinal tolerances than a sleeve for a tool such as Simon. The axial clearance between each end of the sleeve and the adjacent shoulder for prior art tools is about 0.060 inches, but the axial clearance for the sleeve 28 of the present invention can be reduced to about 0.020 inches. Reducing the space between the forward end 31 of the sleeve 28 and the rear annular surface 20 of the flange 18 reduces the amount of fine material cut by the tool that enters between the parts and thereby reduces the wear suffered by these parts.

Figure 4:
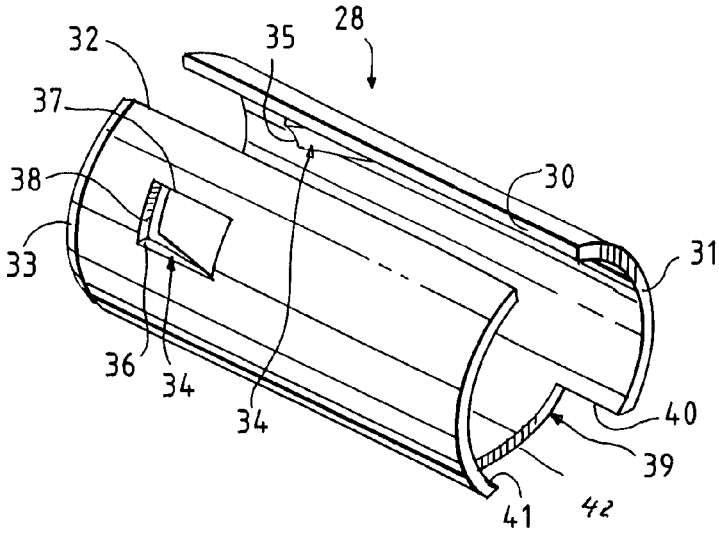
FIG. 4 is an enlarged isometric view of the compressible sleeve shown in FIG. 3.
Figure 5:
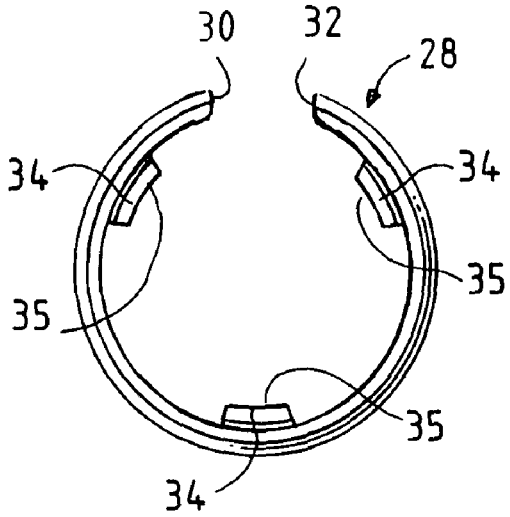
FIG. 5 is an end view of the sleeve shown in FIG. 4.
Figure 6:
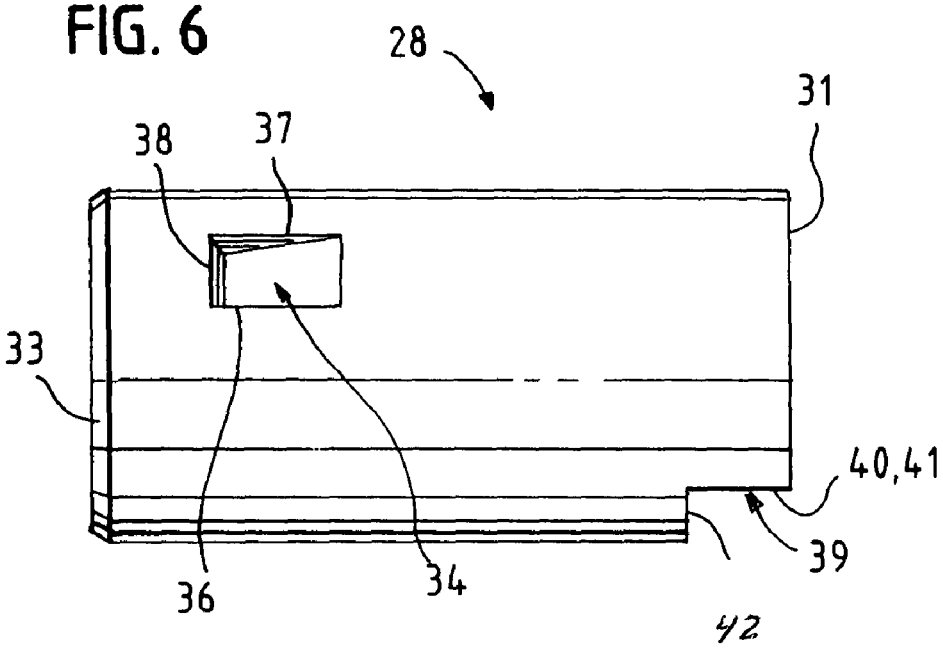
FIG. 6 is a side elevational view of the sleeve shown in FIG. 4.
Figure 10:
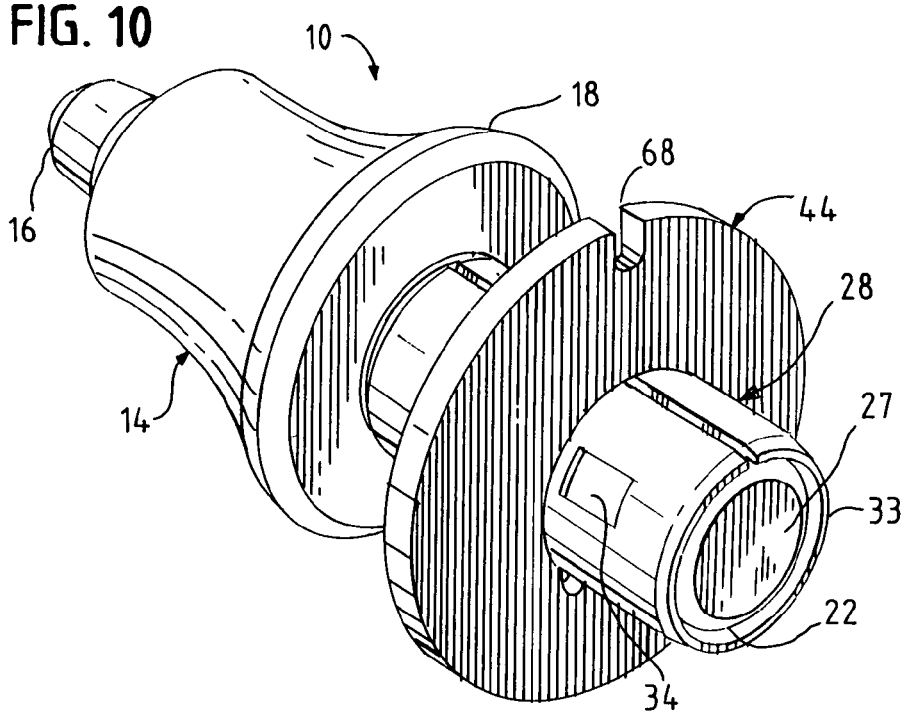
FIG. 10 is another isometric view of the parts assembled shown in FIG. 9.
Figure 11:
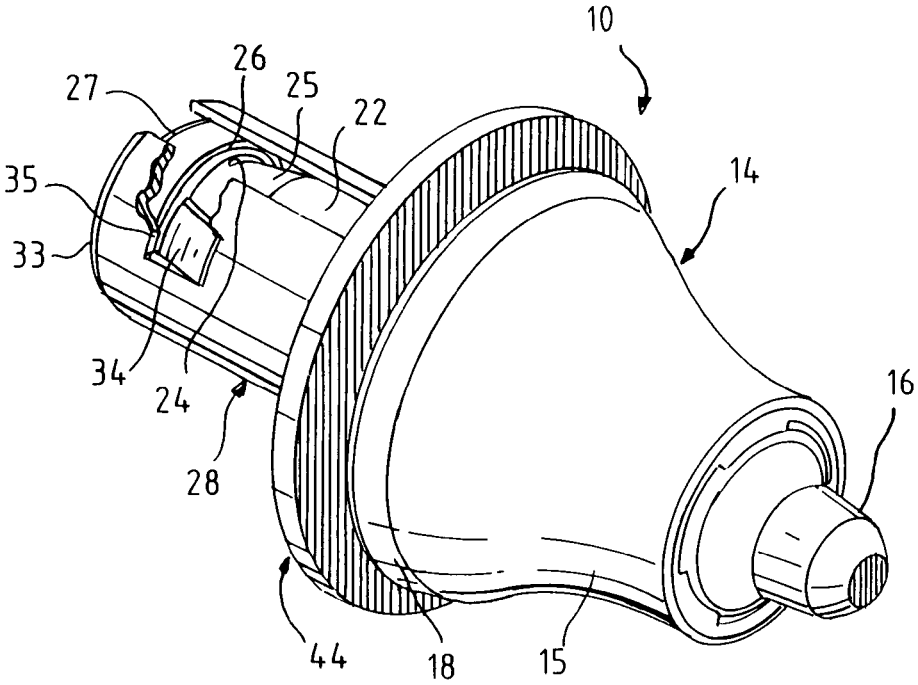
FIG. 11 is an isometric view of the parts after the wear ring has moved to the forward end of the sleeve.

Referring to FIGS. 3 through 6, the compressible sleeve 28 generally defines a hollow cylinder with an elongate slot extending axially along the length of the wall forming parallel spaced slot edges 30, 32. Near the rear end 33 of the sleeve 28 are a plurality of tabs 34 with each of the tabs 34 having a rearwardly and radially inwardly directed free end 35 that engages the groove 24 of the shank 22. As best shown in FIGS. 10 and 11, the free ends 35 of the tabs 34 abut the annular shoulder 26 of the groove 24 to retain the shank 22 within the sleeve 28. As shown in FIGS. 4 and 6, each tab 34 is formed by a pair of parallel axial cuts 36, 37 in the wall of the sleeve 28 and a transverse arcuate cut 38 that connects to the rearward ends of the parallel cuts 36, 37 such that the transverse cut 38 forms the free end 35 of the tab 34. At the forward end of the sleeve 28 positioned one hundred eighty degrees from a center line between the parallel edges 30, 32 of the sleeve 28 is a cut out portion 39 defined by a pair of parallel axial walls 40, 41 and an arcuate wall 42 extending between the rearward ends of the axial walls 40, 41.

Figure 7:
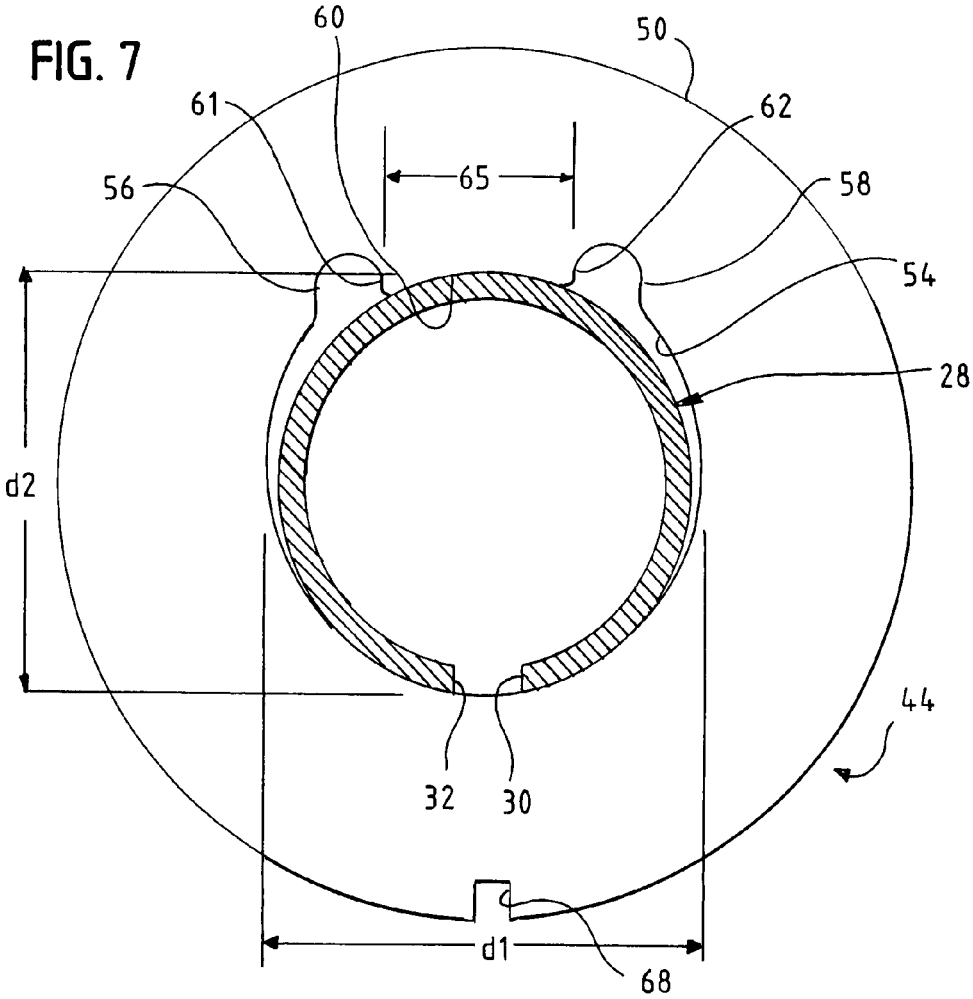
FIG. 7 is a cross-sectional view of the sleeve with the wear ring around the sleeve and the protrusion compressing the sleeve so as to fit tightly around the shank of the tool.
Figure 8:
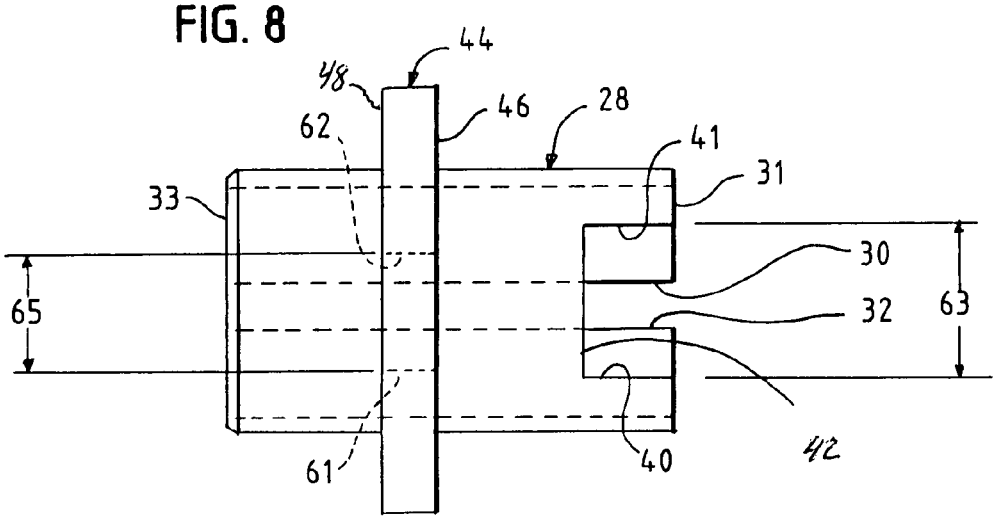
FIG. 8 is a side elevational view of the wear ring assembled on the sleeve, as shown in FIG. 7, with the hidden parts thereof shown in broken lines.
Figure 9:
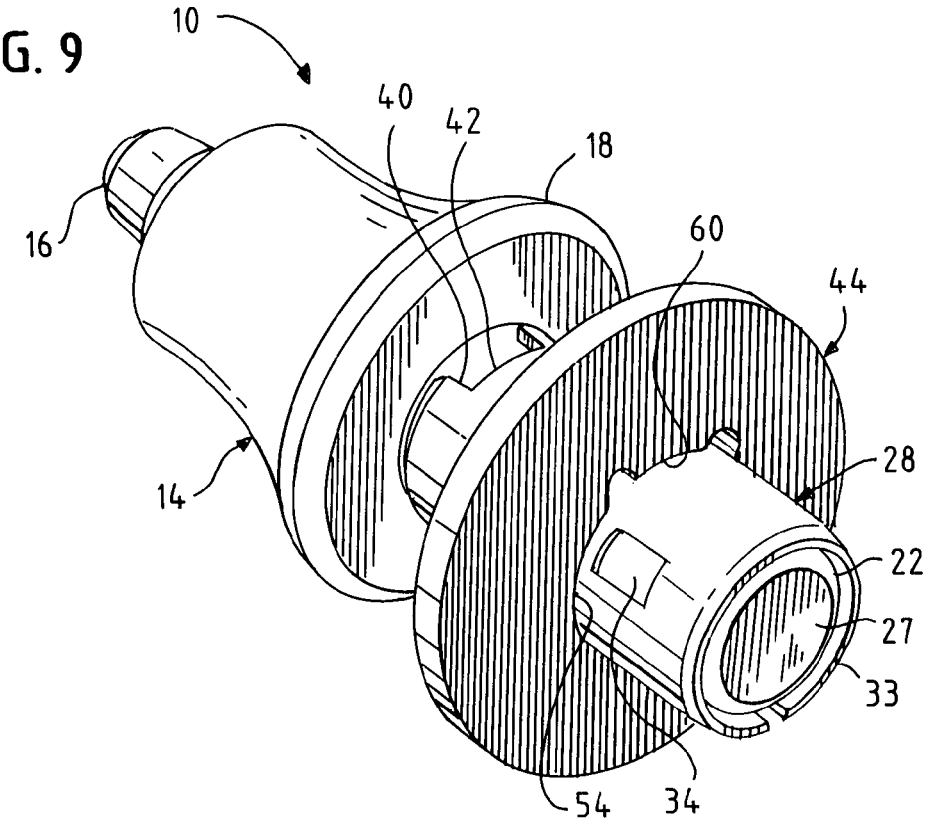
FIG. 9 is an isometric view of the wear ring around a midpoint of the sleeve and shank of the tool with the protrusion aligned behind the cut out portion of the sleeve.

Referring to FIGS. 3, 7, and 8, fitted around the compressible sleeve 28 is a wear ring 44 having a planar forward surface 46, a parallel planar rearward surface 48, a generally cylindrically shaped outer surface 50, and a central opening. The inner wall of the central opening has a semi-cylindrical portion 54, a cross-section of which defines approximately 300 degrees of a circle. At the ends of the semi-cylindrical portion 54 are radially outwardly extending notches 56, 58. Between the notches 56, 58 is a radially inwardly extending projection 60 having sides 61 and 62.

Referring to FIGS. 1 and 7, the radially inwardly directed surface of projection 60 is arcuate and the distance between the end of the inwardly directed projection 60 and the portion of the wall 54 of the central opening diametrically opposite the projection 60, and defining a diameter D2 that is less than the diameter D1 defined by the semi-cylindrical portion 54. The diameter D1 of the opening defined by semi-cylindrical portion 54 is also greater than the diameter 64 of the inner bore of the tool holder 11, but the diameter D2 is less than the inner diameter 64 of the bore 13 of tool holder 11.

As shown in FIGS. 1 through 10, prior to insertion of the shank 22 of the tool 10 into a bore 13 of a tool holder 11, the wear ring 44 is fitted around the circumference of the sleeve 28 with the projection 60 aligned axially behind the cut out portion 39.

Referring specifically to FIGS. 1, 2, and 7 through 12, the inwardly directed protrusion of the projection 60 compresses the sleeve 28 to a diameter D2 that is less than the inner diameter 64 of the bore 13 of the tool holder 11, so that the distal end of the shank 22 of the tool 10, including the rearward portion of the sleeve 28 can be manually inserted by a technician into the bore 13 using only one hand. The machine operator will be able to insert the distal end of the shank 22 and sleeve 28 until the rearward surface 48 of the wear ring 44 contacts the planar forward surface 12 of the tool holder 11. Thereafter, the cutting tip 16 of the tool 10 is pounded with a hammer to drive the shank 22 with the sleeve 28 thereon into the bore 13 of the holder 11. As the shank 22 is driven into the bore 13 the wear ring 44 is moved forwardly along the sleeve 28 until the projection 60 thereof drops into the cut out portion 39, after which the sleeve 28 can expand to the full diameter of the bore 13 of the tool holder 11.

Figure 12:
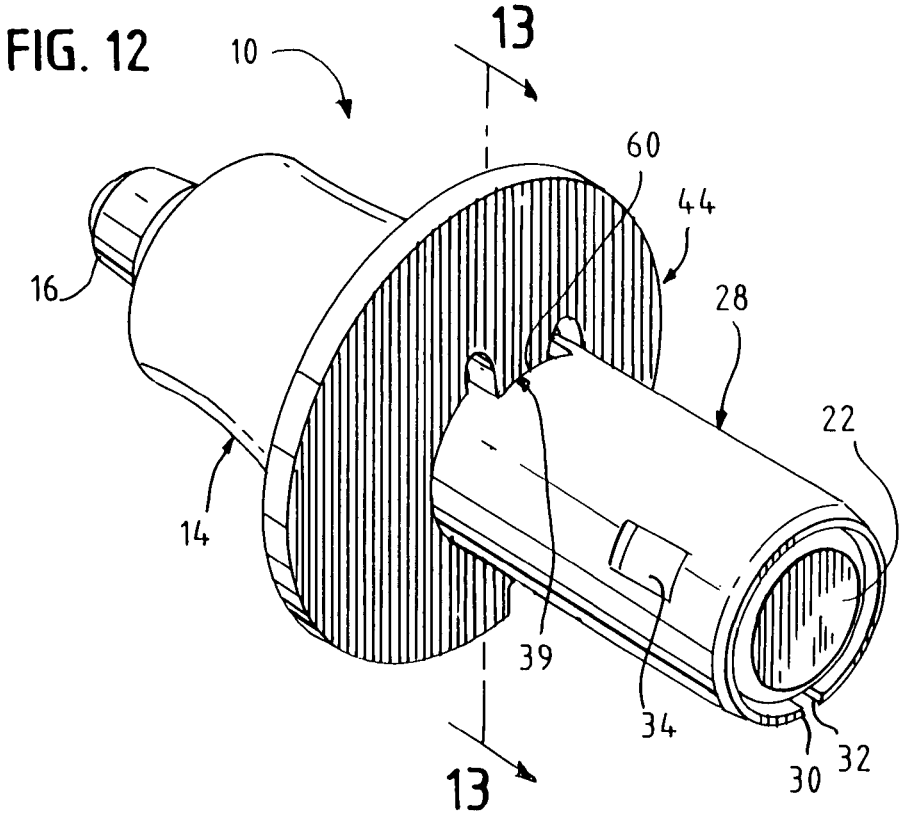
FIG. 12 is another isometric view of the parts configured as shown in FIG. 11.
Figure 13:
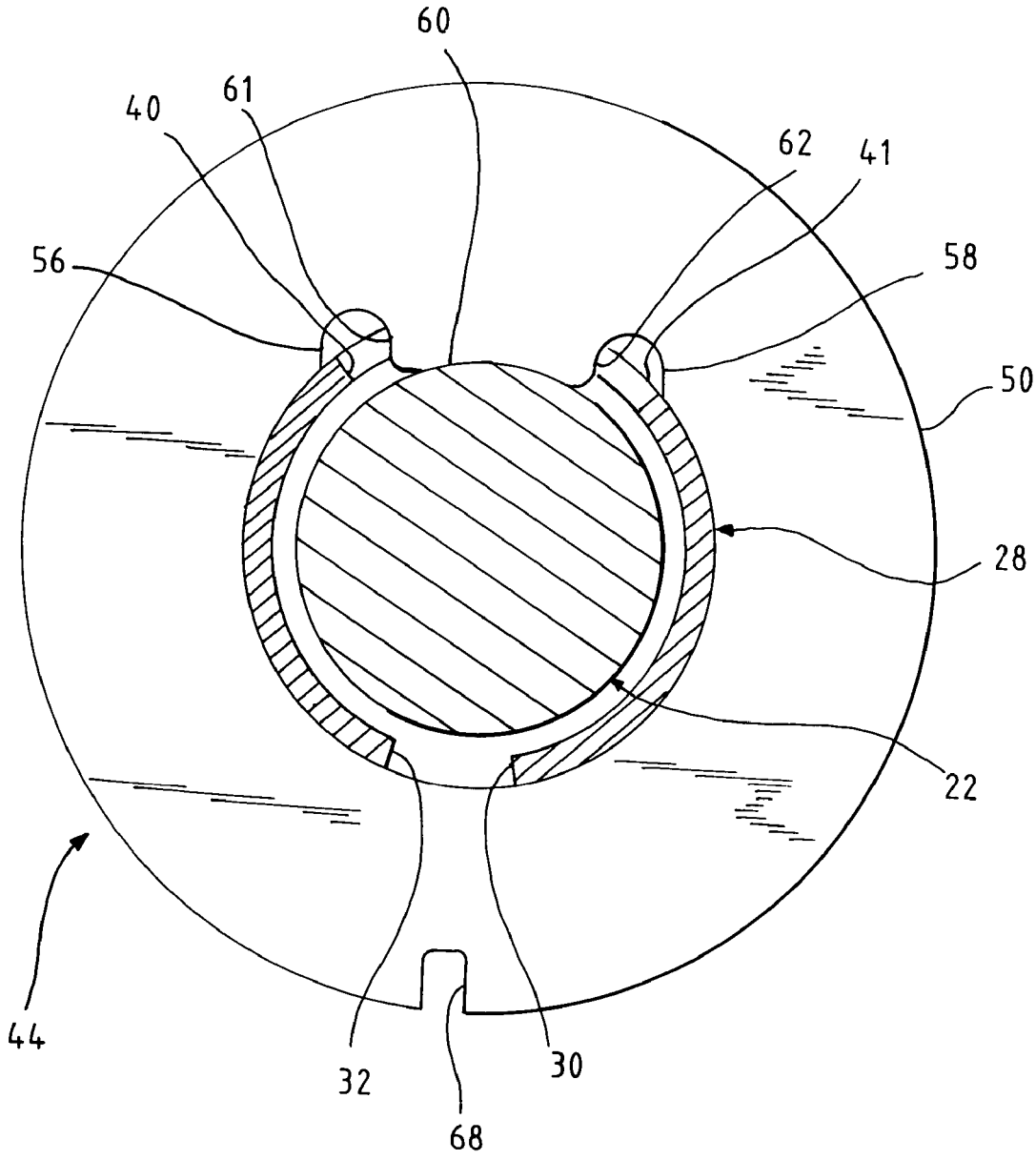
FIG. 13 is a cross-sectional view of the wear ring and sleeve with the wear ring around the forward end of the sleeve and the projection of the wear ring extending into the cut out portion of the sleeve.

Referring to FIG. 8, an important aspect of the invention is that the axial walls 40, 41 of the cut out portion at the forward end of the sleeve 28 are spaced a distance 63 apart from each other that is greater than the width 65 of the projection 60 of the wear ring 44 as defined by the distance between the sides 61 and 62. As shown in FIGS. 12 and 13, when the shank 22 of the tool 10 is driven entirely into the bore 13 of the tool holder 11, the wear ring 44 will be forced to the forward end of the sleeve 28 and the projection 60 will drop between the axial walls 40, 41 of the compressible sleeve 28. When this occurs, the compressible sleeve 28 will be released from beneath the projection 60 and allowed to expand. Since the diameter defined by semi-cylindrical portion 54 is larger than the diameter of the inner bore 13 of the tool holder 11, the compressible sleeve will expand until the outer surface thereof contacts the inner surface of the bore 13 of the tool holder 11. The tool 10 will thereafter be retained within the bore 13 of the tool holder 11 by the radially outwardly applied force of the partially compressed sleeve 28. Furthermore, the wear ring 44 will be retained against rotation by sleeve 28 by the contact of the sides 61, 62 of the projection 60 against the axial walls 40, 41 of the cut out portion 39 at the forward end of the sleeve 28. Accordingly, the wear ring 44 is prevented from rotating with the tool 10 and will not cause rotational wear to the forward surface 12 of the tool holder 11.

Referring to FIG. 2, the cylindrical outer surface 50 of the wear ring 44 has a diameter D3 that is generally greater than the diameter D4 of the generally circular forward surface 12 of the tool holder 11. The enlarged outer diameter of the wear ring provides protection to the forward end of the tool holder 11 and forms an outwardly projecting flange that can be struck using a hammer and chisel, not shown, to remove the tool 10 from the tool holder 11.

Referring to FIGS. 7, 10, and 13, extending into the outer surface 50 of the wear ring 44 is a notch 68 that is preferably positioned diametrically opposite the center of the projection 60 as shown. The notch 68 is adapted to receive a guide, not shown, on a machine, also not shown, for assembling the sleeve 28 and the wear ring 44 to the tool body 14. The guide on the machine aids in aligning the projection 60 of the wear ring 44 axially behind the cut out portion 39 of the sleeve 28.

While the invention has been described with respect to a single embodiment, it will be appreciated that many modifications and variations may be made without departing from the true spirit and scope of the invention. It is therefore the intent of the appended claims to cover all such modifications and variations which fall within the spirit and scope of the invention.

What is claimed is:

1. A rotatable tool assembly for insertion into a tool holder having a cylindrical opening having a given diameter, said tool assembly comprising a tool body having a tapered forward cutting end, an axial shank extending rearwardly of said forward cutting end, and a rearwardly facing annular surface between a rearward end of said forward cutting end and a forward end of said shank, a compressible sleeve around said shank, said compressible sleeve having an outer surface, a forward end, and a longitudinal slot having generally parallel spaced apart slot edges, said compressible sleeve having a cut out portion at said forward end, an annular wear ring having a central opening and a projection extending radially inward of said central opening, said wear ring around a central portion of said compressible sleeve with said projection axially aligned behind said cut out portion and compressing said compressible sleeve, and said outer surface being free of obstruction to the axial movement of said wear ring along said sleeve to said forward end.

2. The tool assembly of claim 1 wherein said cut out portion is circumferentially spaced from both said slot edges.

3. The tool assembly of claim 2 wherein said cutout portion is positioned diametrically opposite said parallel spaced apart slot edges.

4. The tool assembly of claim 1 wherein said cut out portion has a first width, and said projection has a second width that is less than said first width.

5. The tool assembly of claim 1 wherein said wear ring has an inner wall forming an inner opening, said inwardly directed projection extends radially inward of a cylinder defined by said inner wall, a distance between an inner end of said projection and a portion of said inner wall diametrically opposite said projection is less than said given diameter, and said compressible sleeve is compressed to a first diameter less than said given diameter.

6. The rotatable tool assembly of claim 1 wherein said cut out portion has a first width, said projection has a second width that is less than said first width, said wear ring is axially moveable along said compressible sleeve to a position around said forward end wherein said protrusion will fall into said cut out portion and said compressible sleeve will expand to a second diameter larger than said first diameter, and a surface on said protrusion will contact a side wall of said cut out portion to lock said wear ring against rotation with respect to said sleeve.

7. The tool of claim 6 wherein said cut out portion is only at a forward end of said sleeve.

8. The rotatable tool of claim 6 wherein said cut out portion is circumferentially spaced from said slot edges.

9. The tool assembly of claim 1 wherein said wear ring is axially moveable along said sleeve to said forward end of said sleeve, and said projection having a width that is less than a width of said cut out portion wherein said projection will fall into said cut out portion when said wear ring is moved to said forward end.

10. A rotatable tool assembly for insertion into a tool holder having a cylindrical opening, said tool assembly comprising a tool body having a tapered forward cutting end, an axial shank extending rearwardly of said forward cutting end, and a rearwardly facing annular surface between a rearward end of said forward cutting end and a forward end of said shank, a generally cylindrical compressible sleeve around said shank, said compressible sleeve having a forward end adjacent said annular surface, and a longitudinal slot having generally parallel spaced apart slot edges, said compressible sleeve having a cut out portion at said forward end circumferentially spaced from said longitudinal slot, said cut out portion having a first width, an annular wear ring having a central opening and a projection extending radially inward of said central opening, said projection having a second width less than said first width, said wear ring around said compressible sleeve with said projection aligned axially rearward of said cut out portion, said compressible sleeve compressed by said projection to a first diameter, and said wear ring axially moveable along said compressible sleeve to a position around said forward end thereof where said projection will extend into said cut out portion and said compressible sleeve will expand to a second diameter larger than said first diameter.

11. The rotatable tool assembly of claim 10 wherein said second diameter is greater than a diameter of said cylindrical bore of said tool holder wherein said compressible sleeve will expand against an inner surface of said cylindrical bore and retain said tool assembly therein.

12. The tool assembly of claim 10 wherein said cylindrical opening of said tool holder has a diameter that is greater than said first diameter wherein a portion of said compressible sleeve can be manually inserted into said cylindrical opening.

13. The tool assembly of claim 10 wherein said cylindrical opening of said tool holder has a diameter that is less than said second diameter wherein said compressible sleeve will retain said tool assembly within said cylindrical bore when said projection is extending into said cut out portion.

14. The tool assembly of claim 10 wherein said central opening defines a cylinder and said projection extends radially inward of said cylinder defined by said central opening.

15. In a tool having a tool body with a tapered forward cutting end, an axial shank extending rearwardly of said forward cutting end, and a rearwardly facing planer annular surface joining a rearward end of said forward cutting end to a forward end of said shank, a compressible sleeve having a longitudinal slot defined by a pair of generally parallel slot edges around said shank, and a wear ring around said shank adjacent said planar annular surface, the improvement comprising said compressible sleeve having a cut out portion at a forward end thereof and circumferentially spaced from said slot edges, said forward end immediately adjacent said planar annular surface, and said compressible sleeve having an outer surface defining a cylinder and no portion of said compressible sleeve extending radially outward of said cylinder, said wear ring having an inner annular wall defining a central opening, and a radially inwardly directed projection on said inner annular wall extending into said cut out portion for locking said wear ring to said sleeve wherein said wear ring cannot rotate with respect to said sleeve.

16. A rotatable tool assembly for insertion into a tool holder having a cylindrical opening, said tool assembly comprising a tool body having a tapered forward cutting end, an axial shank extending rearwardly of said forward cutting end, and a rearwardly facing planar annular surface between a rearward end of said forward cutting end and a forward end of said shank, a compressible sleeve around said shank having an outer surface that generally defines a cylinder, said compressible sleeve having a forward end adjacent said planar annular surface and a longitudinal slot having generally parallel spaced apart slot edges, no portion of said compressible sleeve extending radially outward of said cylinder, said compressible sleeve having a cut out portion at said forward end, said cut out portion circumferentially spaced from both said slot edges, said cut out portion having a first width, an annular wear ring having a central opening and a projection extending radially inward of said central opening, said projection having a second width less than said first width, said wear ring around said compressible sleeve with said projection extending into said cut out portion, wherein said wear ring is locked against rotation with said tool body.

17. The rotatable tool assembly of claim 16 wherein said central opening of said wear ring defines a cylinder having a diameter larger than a diameter of said cylindrical opening of said tool holder and wherein said compressible sleeve will retain said rotatable tool within said tool holder.

18. The tool assembly of claim 16 and further comprising said compressible sleeve having a forward end and a rearward end, and said slot edges extending continuously from said forward end to said rearward end.

* * * * *